US006072307A

United States Patent [19]

Yeshurun et al.

[11] Patent Number: 6,072,307

[45] Date of Patent: Jun. 6, 2000

[54] METHOD AND A CONVERTER TOPOLOGY FOR ENSURING CHARGE AND DISCHARGE THROUGH A COIL SO AS TO ALLOW SIMULTANEOUS AND INDEPENDENT CHARGE AND DISCHARGE THEREOF

[75] Inventors: Yosef Yeshurun, Ganei Tikva; Yehoshua Wolfus, Kiryat Ono; Eliezer Perel, Ramat Gan; Moshe Sinvani, Rishon LeZion; Noam Shaked, Ramat Gan; Alexander Friedman, Tel Aviv, all of Israel

[73] Assignee: Bar-Ilan University, Ramat Gan, Israel

[21] Appl. No.: 09/221,973

[22] Filed: Dec. 29, 1998

Related U.S. Application Data

[60] Provisional application No. 60/071,852, Jan. 20, 1998.

[51] Int. Cl.[7] ..... H01F 36/00

[52] U.S. Cl. ..... 323/360; 505/870

[58] Field of Search ..... 323/355, 360; 361/19; 505/850, 867, 868, 869, 870; 363/14

[56] References Cited

U.S. PATENT DOCUMENTS

| | | | |
|---|---|---|---|
| 4,431,960 | 2/1984 | Zucker | 323/340 |
| 4,695,932 | 9/1987 | Higashino | 363/14 |
| 4,954,727 | 9/1990 | Hilal | 307/112 |
| 5,218,505 | 6/1993 | Kubo et al. | 505/850 |
| 5,305,111 | 4/1994 | Yamaguchi | 361/19 |
| 5,612,615 | 3/1997 | Gold et al. | 323/360 |

*Primary Examiner*—Matthew Nguyen
*Attorney, Agent, or Firm*—Browdy and Neimark

[57] ABSTRACT

A method and converter topology for ensuring charge and discharge of electric current to a coil so as to allow simultaneous and independent charge and discharge thereof, particularly suitable for a superconducting coil and showing an increase in power transfer by a factor of up to two as compared with prior art converters.

17 Claims, 4 Drawing Sheets

METHOD AND A CONVERTER TOPOLOGY FOR ENSURING CHARGE AND DISCHARGE THROUGH A COIL SO AS TO ALLOW SIMULTANEOUS AND INDEPENDENT CHARGE AND DISCHARGE THEREOF

This application claims the benefit of U.S. provisional application No. 60/071,852, filed Jan. 20, 1998.

FIELD OF THE INVENTION

This invention relates to electrical circuits of converters operating with the participation of charge and discharge of the electric current through a coil.

BACKGROUND OF THE INVENTION

Many power electric circuits require the conversion of electric power from one form to another. For example, various types of converter circuits are used as energy stabilizing devices for an AC or DC load. Such converter circuits are typically based on the storage of electrical energy in a coil during one certain moment and which is transferred to a load during a moment after. The energy is stored as a magnetic field around the coil so that the actual energy transfer realized by the discharge of the coil comprises the conversion of magnetic energy to electrical energy.

In most converters, the build-up of magnetic energy through the coil and its subsequent discharge are two independent phases which are performed concurrently. That is to say, energy is first built-up around the coil as a magnetic field and, during a subsequent independent stage, the coil is connected to an external load so that the stored energy can discharge through the load, thereby supplying energy thereto.

U.S. Pat. No. 4,695.932 (Higashino) describes a circuit for storing energy delivered from an AC supply which comprises a DC capacitor and reversible chopper between an AC/DC reversible conversion circuit connected to the AC supply and a current supply circuit including a superconductive coil. This capacitor is connected intermittently to the superconductive coil in response to the action of the reversible converter, so that when connected it delivers energy to the superconductive coil or receives energy therefrom. The reversible chopper circuit controls in accordance with required values the magnitude of transfer of energy between the DC capacitor and the superconductive coil.

By such means, a DC capacitor is intermittently connected to the superconductive coil by the action of the reversible chopper circuit which controls the coil current flow, and thereby acts so that energy is delivered to, and released from, the superconductive coil. By such means, energy can be stored in a superconductive coil when demand is low and can be withdrawn from the coil when demand is high thereby reducing large fluctuations in demand and achieving a more stable output.

However, the charge and discharge pulses are applied to the coil concurrently and this means that the energy stored within the coil cannot be increased during discharge. Since the coil functions as an energy reservoir, this is not an efficient manner of the energy control. This is somewhat analogous to allowing a water tank to supply water only when there is no income of water and vice versa when obviously it would be preferable to allow charge and discharge to be effected simultaneously and independently.

However, no such implementation has been suggested in the prior art.

SUMMARY OF THE INVENTION

It is therefore an object of the present invention to provide a method of charge and discharge of electromagnetic energy through a coil so as to allow simultaneous and independent charge and discharge thereof.

It is a further object of the present invention to provide a converter topology for enabling charge and discharge through a coil so as to allow simultaneous and independent charge and discharge thereof.

According to a broad aspect of the invention there is provided a method of charge and discharge of electric current through a supper conducting coil so as to allow simultaneous and independent charge and discharge thereof, the method comprising the steps of:

(a) connecting a power source to the coil via a first switchable path, (b) connecting a load to the coil via a second switchable path, and (c) selectively switching said first and second switchable path according to whether it is required to charge or discharge the coil independently or to charge and discharge the coil simultaneously.

According to a further aspect of the invention there is provided a converter topology for ensuring charge and discharge of electric current through a supper conducting coil so as to allow simultaneous and independent charge and discharge thereof, the converter topology comprising:

at least two switchable paths coupled to the coil and being respectively connected to a power source and a load, control circuit coupled to said switchable paths for selectively switching thereof according to whether it is required to charge or discharge the coil independently or to charge and discharge the coil simultaneously.

BRIEF DESCRIPTION OF THE DRAWINGS

In order to understand the invention and to see how the invention may be carried out in practice, some preferred embodiments will now be described, by way of non-limiting example only, with reference to the accompanying drawings, in which.

DETAILED DESCRIPTION OF A PREFERRED EMBODIMENT

Figure 1A:
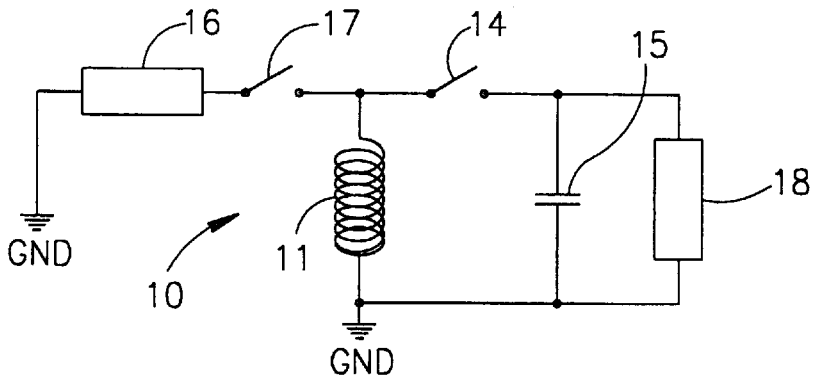
FIG.1A PRIOR ART
FIGS. 1*a* and 1*b* show two typical circuit configurations of a prior art converter.
Figure 1B:
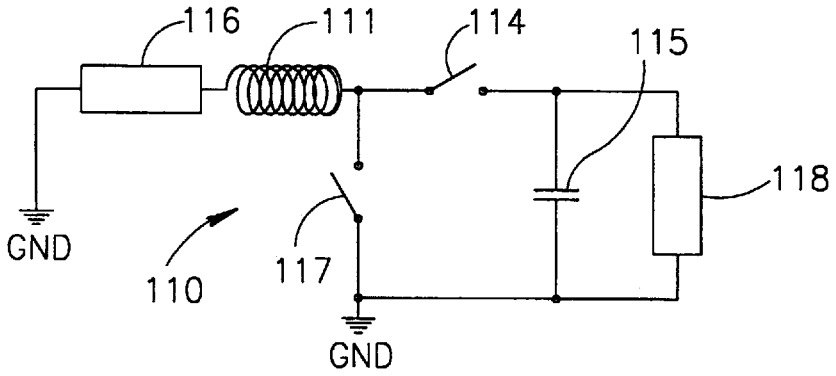
FIG.1B PRIOR ART

FIGS. 1*a* and 1*b* show two kinds of prior art converter arrangements. The first shown in FIG. 1*a* and depicted generally as 10 includes a coil 11 having a first end 12 connected to GND and having a second end 13 connected via a switch 14 to a Load across which there is connected a capacitor 15. The coil 11 is charged by a power source 16 connected between GND and the second end 13 of the coil via switch 17. The coil 11 is charged by closing the switch 17 and opening the switch 14, whereupon the load L is disconnected from the coil 11 and continues to receive energy from the capacitor 15, which is charged by the coil 11 during the time that the switch 14 is closed and switch 17 is opened.

Therefore, in order to ensure that the load L is not subject to intermittent interruption of energy, the switch 14 must be closed before the capacitor 15 becomes discharged below a permitted level. At the same time, the switch 14 must be left open for a sufficient period of time to allow for the coil 11 to store sufficient charge from the power source 16.

In such an arrangement, the coil is therefore either charged (when the switch 14 is open and the switch 17 is closed) or is discharged (when the switch 14 is closed and the switch 17 is open) and the continuity and stability of the energy applied to the load L is dependent only on the smoothing effect of the capacitor 15.

The second prior art converter arrangement shown in FIG. 1*b* and depicted generally as 110 includes a coil 111 having a first end 112 connected to power source 116 and having a second end 113 connected via a switch 114 to a load across which there is connected a capacitor 115. The coil 111 is charged continuously by a power source 116 connected between GND and the end 112 of the coil. The coil 111 is charged only when the switch 117 is closed and the switch 114 is open, whereupon the load L is disconnected from the coil 111 and continues to receive energy from the capacitor 115 which is charged by the coil 111 during the time that the switch 114 is closed. In this arrangement independent discharge of the coil 111 is prohibited.

Figure 2:
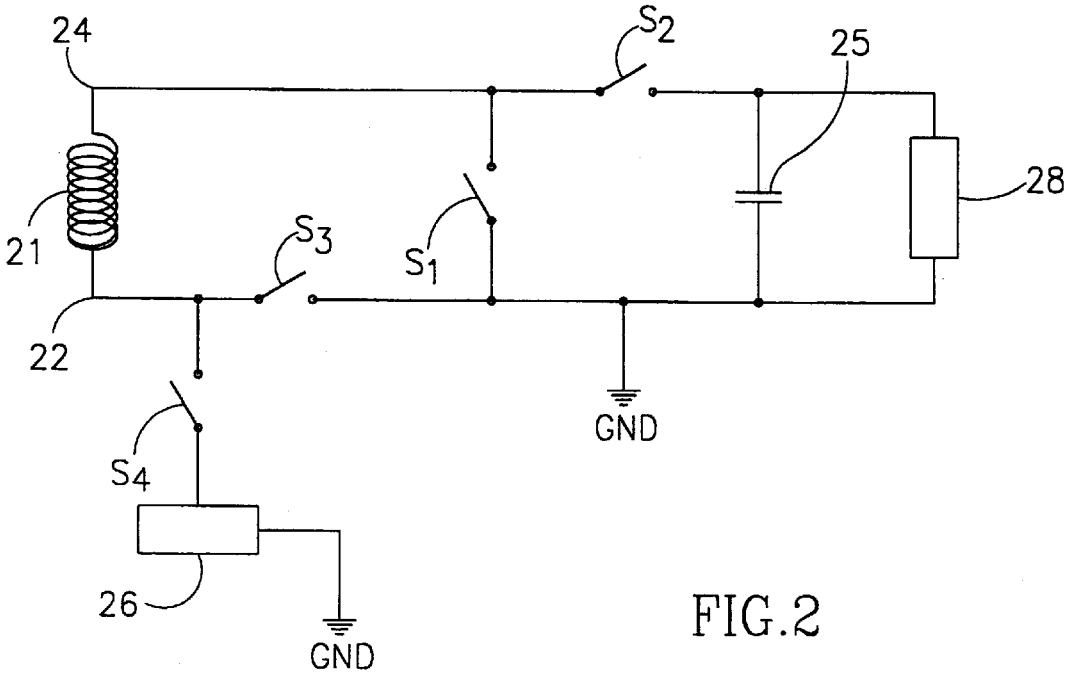
FIG. 2 shows schematically a circuit arrangement according to a first embodiment of the invention.

FIG. 2 shows schematically a converter configuration according to the invention depicted generally as 20 and including a coil 21 having a first end 22 which is connected to a power source 23 via a switch $S_4$, a second end of the power source 23 being connected to GND. A second end 24 of the coil 21 is connected, via a switch $S_2$ to a load L which, in turn, is connected to GND and across which is a smoothing capacitor 25.

The first end 22 of the coil 21 is connected via a switch $S_3$ to GND, whilst the second end 24 of the coil 21 is connected via a switch $S_1$ to GND.

Figure 6:
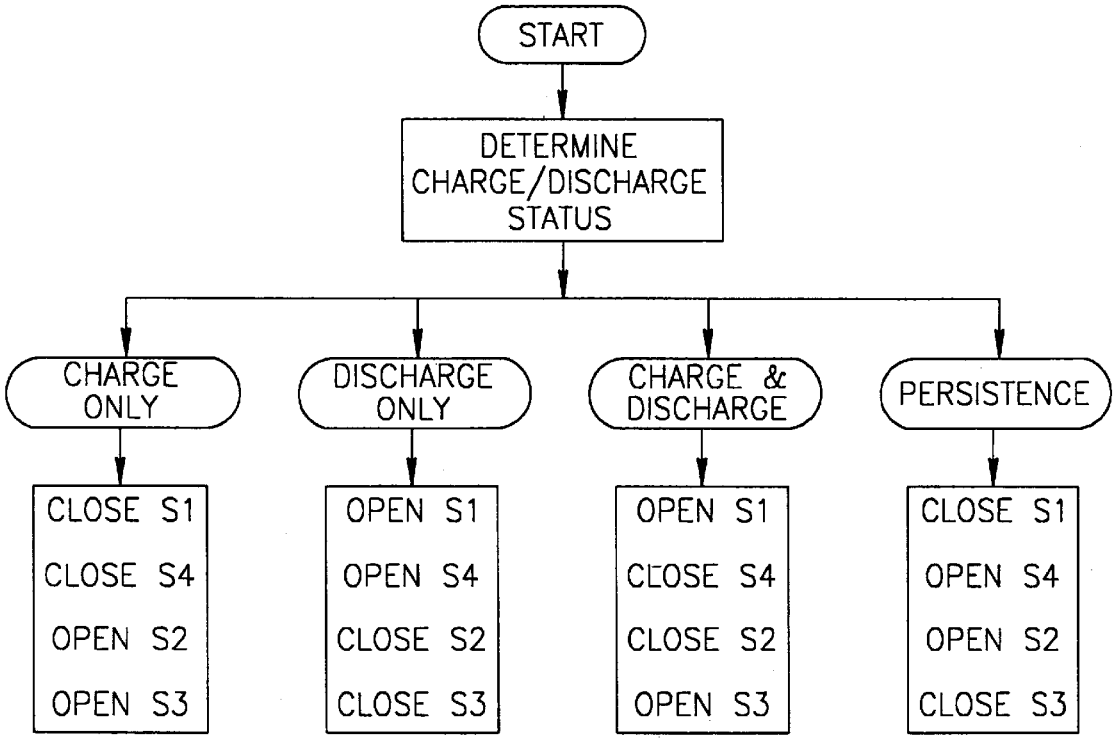
FIG. 6 is a state table relating to operation of the controller shown in FIG. 5.

Such a circuit configuration allows for four different states depending on whether the switches $S_1$ to $S_4$ are opened or closed. Thus, if it is desired to charge the coil 21 whilst preventing discharge thereof through the load L then, as shown in FIG. 6, switches $S_1$ and $S_4$ must be closed whilst switches $S_2$ and $S_3$ are opened. On the other hand, when it is desired to discharge the coil 21 through the load L whilst preventing charge of the coil 21, then switches $S_1$ and $S_4$ are opened whilst switches $S_2$ and $S_3$ are closed.

The configuration shown in FIG. 2 also allows for the coil 21 to be charged by the power source 23 whilst, at the same time, discharging through the load L. In this situation, switches $S_1$ and $S_3$ are opened whilst switches $S_2$ and $S_4$ are closed.

Preferably, this coil 21 is a superconducting coil with effectively zero energy losses. In this case opening switches $S_2$ and $S_4$ , the load L and the power source are disconnected from the coil 21 whilst switches $S_1$ and $S_3$, being closed, shorts the two ends 22 and 24 of the coil thereby allowing electric current to flow losslessly through the coil so as to make energy available for discharging to the capacitor 25 and feeding the load L when the switch $S_1$ is eventually opened and the coil 21 connected across the load L.

Figure 3:
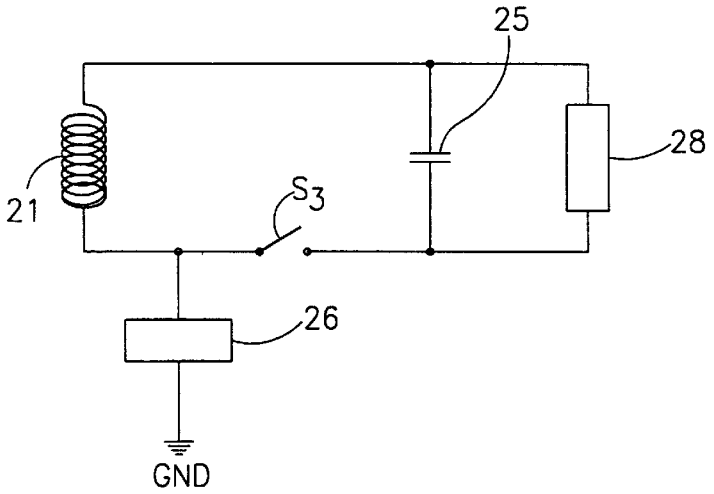
FIG. 3 depicts the equivalent switching configuration of FIG. 2 during simultaneous charge and discharge of the coil.

FIG. 3 shows the effect in FIG. 2 of closing switches $S_2$ and $S_4$, whilst switches $S_1$ and $S_3$ are opened, whereby it can readily be seen that the load L receives charge from the coil 21 which is connected to GND via the power source 23. Consequently, in such a configuration, the coil 21 both charges and discharges simultaneously.

Figure 4:
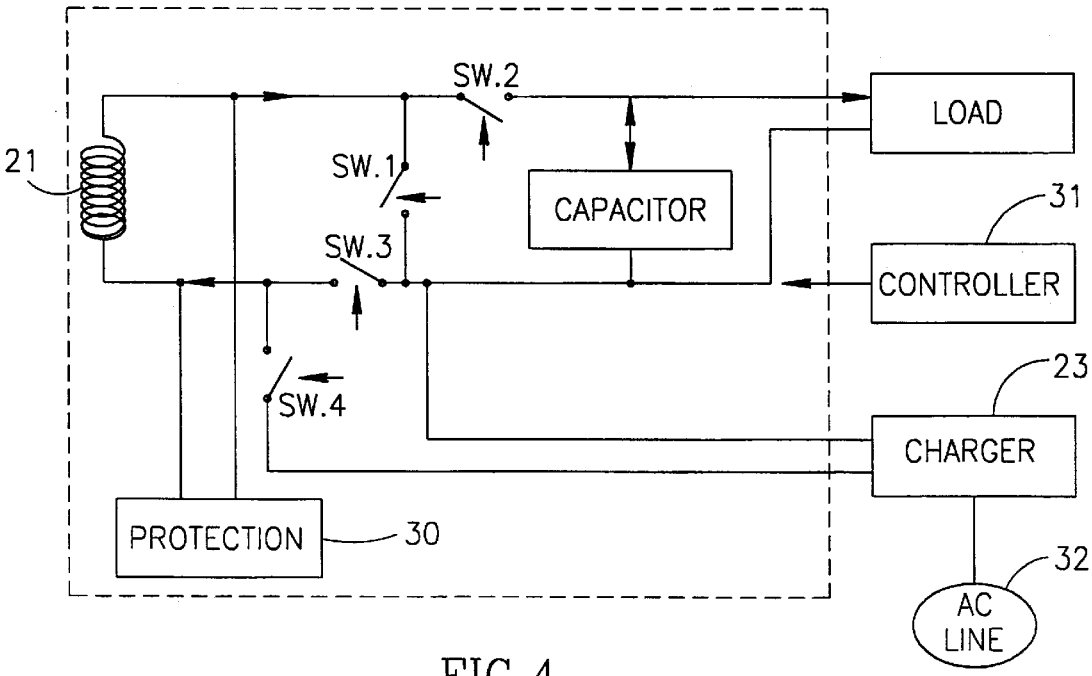
FIG. 4 shows schematically a system including a converter with a superconducting coil according to FIG. 2.

FIG. 4 shows a more detailed diagram of a switching circuit having switches $S_1$, $S_2$, $S_3$ and $S_4$ as depicted in FIG. 2 but further showing details, albeit schematically, of a protection circuit 30 and a controller 31.

Figure 5:
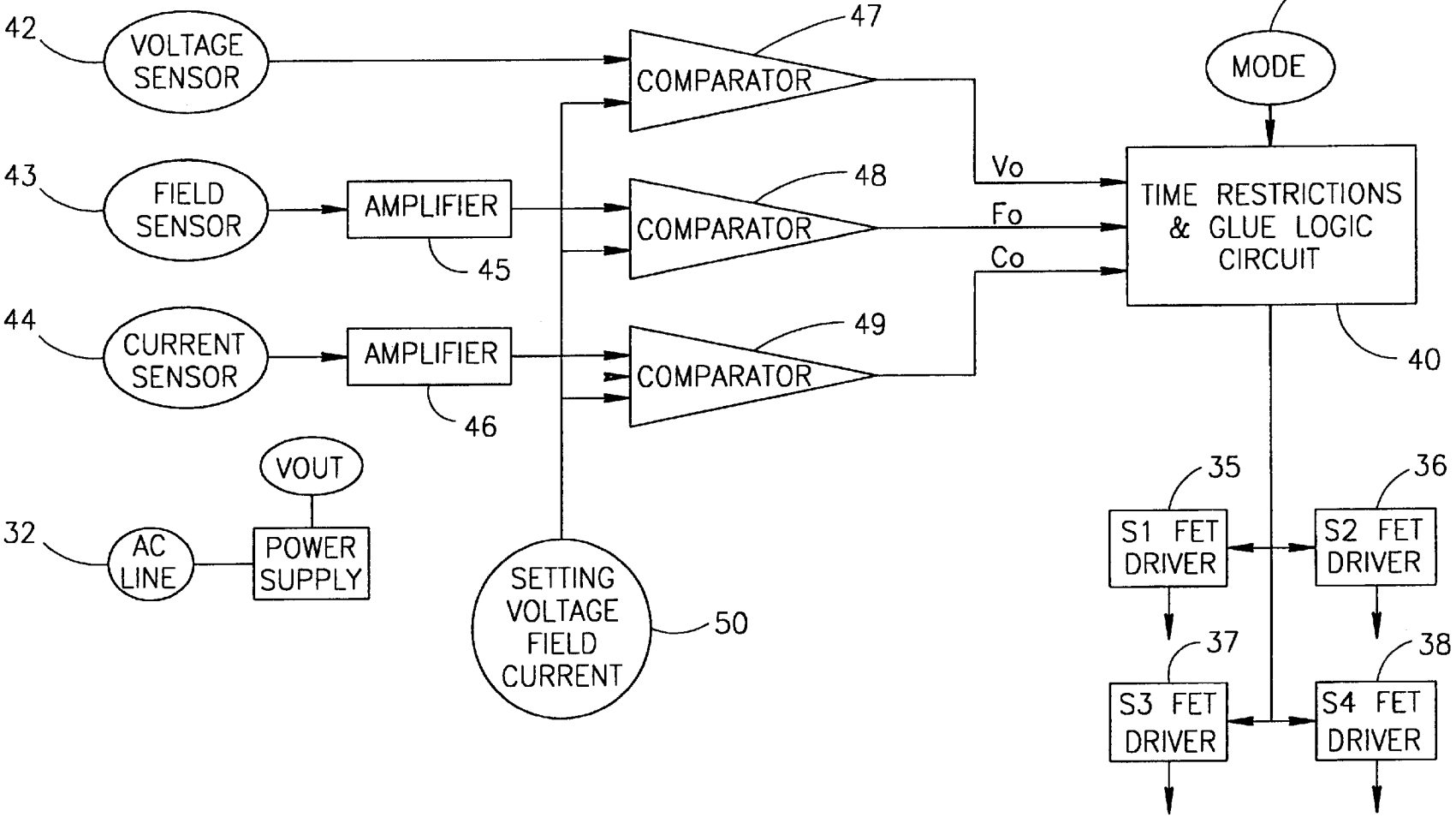
FIG. 5 shows schematically a controller for the switching circuit of FIG. 4.

FIG. 5 shows schematically a functional representation of the controller 31 employing four switch drivers 35 36, 37 and 38 which are responsively coupled to a TIME RESTRICTIONS & GLUE LOGIC CIRCUIT 40 for controlling the four switches $S_1$ to $S_4$ shown in FIG. 4.

The TIME RESTRICTIONS & GLUE LOGIC CIRCUIT 40 is responsive to a mode selection 41 as well as to three inputs OV, OF and OC representative of the overvoltage, overfield and overcurrent across or through the coil 21 respectively, for switching the respective switch drivers 35 to 38 in order that the desired configuration of the switching circuit will be achieved.

The voltage on the load and field of the coil 21 are derived by respective voltage and field sensors 42 and 43 whilst the current flowing through the coil 21 is derived by a current sensor 44. The field and current sensors 43 and 44 are connected to respective amplifiers 45 and 46. The voltage signal derived by the voltage sensor 42 as well as the amplified field and current signals derived at the output of the respective amplifiers 45 and 46 are fed to the non-inverting inputs of respective comparators 47, 48 and 49.

Respective inverting inputs of the three comparators 47, 48 and 49 are connected to a voltage, field and current setting device 50 for setting the desired voltage, field and current thresholds. Thus, the three desired set signals OV, OF and OC are derived at the respective outputs of the comparators 47, 48 and 49 and are fed to the time restrictions & glue logic circuit 40 for controlling the four switch drivers 35 to 38.

The control circuit thus provides control signals for the four switches $S_1$ to $S_4$ in order to achieve the desired characteristics of the input current and to yield desired output voltages and energy level in the coil 21. As a result of this optimization, the power transferred by the coil 21 is increased by a factor of up to 2 with respect to prior art devices.

FIG. 6 summarizes the status of the four switches $S_1$ to $S_4$ according to whether the coil 21 is to be operated in charge only mode, discharge only mode, charge and discharge mode or persistence mode, these modes can also be selected manually by the mode selector switch 41 shown in FIG. 5.

However it is also contemplated that some of the switches $S_1$ to $S_4$ may be replaced by rectifier diodes which allow current to flow in only one direction and thus may behave as open or closed switches depending on the voltage polarity.

Figure 7:
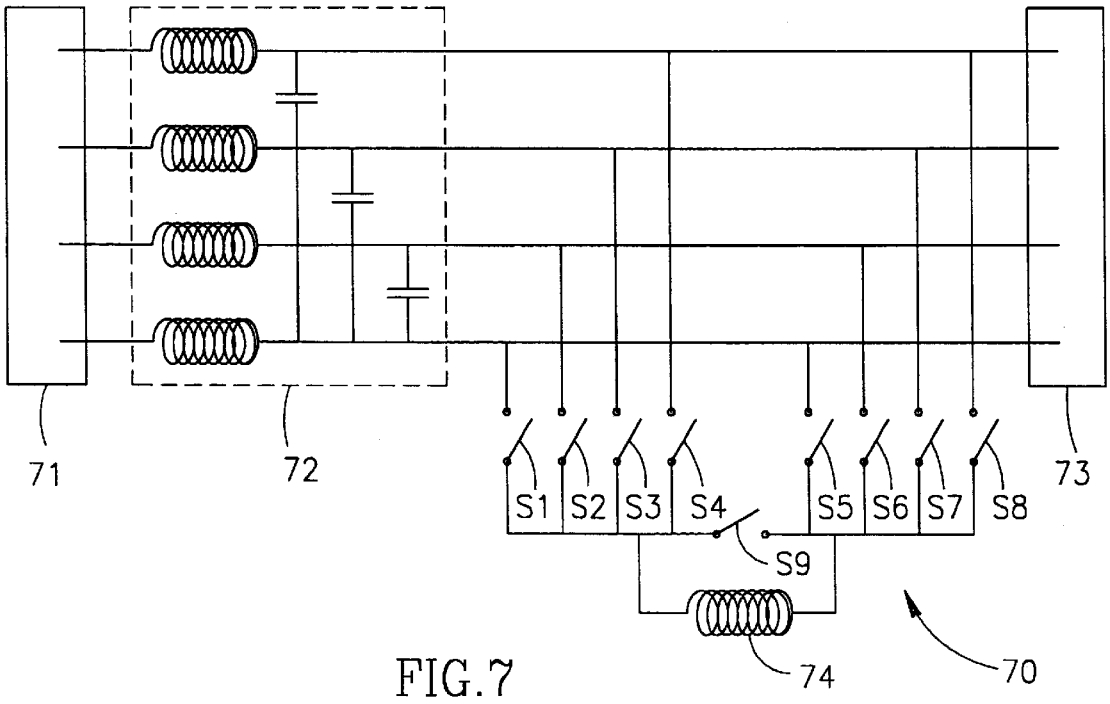
FIG. 7 shows schematically an AC—AC converter arrangement wherein the power source is 3 phase AC-grid having a 3-phase load directly connected thereto.

FIG. 7 shows the topology of the AC—AC converter depicted generally as 70 containing a set of eight switches $S_1$ to $S_8$ directly connected to a 3-phase AC-grid having an incoming 3-phase feeder 71. A line filter 72 is connected across the incoming 3-phase feeder 71 and a load 73 is connected in parallel with the switches $S_1$ to $S_8$. A coil 74 has one end connected to the four switches $S_1$ to $S_4$ and has its other end connected to the four switches $S_5$ to $S_8$. A switch $S_9$ ensures 'persistent current' mode of the operation of the coil 74.

At any moment according to the situation of a particular phase the coil 74 may be charged or discharged from this phase by connecting the appropriate end of the coil to this phase and the second end to the star point "0" thereby enabling charge or discharge of the coil 74. According to the situation of a second phase at the same moment, the second end of the coil 74 can be connected to this second phase for simultaneous charge and discharge of the coil or charge/discharge from both phases.

In addition to the configurations described above, a DC power source can also be employed together with either a single-phase or 3-phase AC line. In either case any combination of DC load, single-phase AC load or 3-phase AC load may be connected thereto.

We claim:

1. A method of charge and discharge of electric current through a superconducting coil so as to allow simultaneous and independent charge and discharge thereof, the method comprising the steps of:

(a) connecting a power source to the coil via a first switchable path, (b) connecting a load to the coil via a second switchable path, and (c) selectively switching said first and second switchable path according to whether it is required to charge or discharge the coil independently or to charge and discharge the coil simultaneously.

2. A converter topology for ensuring charge and discharge of electric current through a superconducting coil so as to allow simultaneous and independent charge and discharge thereof, the converter topology comprising:

at least two switchable paths coupled to the coil and being respectively connected to a power source and a load, control circuit coupled to said switchable paths for selectively switching thereof according to whether it is required to charge or discharge the coil independently or to charge and discharge the coil simultaneously.

3. The converter topology according to claim 2, wherein at least one of the switchable paths contains a rectifier diode which is biased to block current flow of a predetermined polarity.

4. The converter topology according to claim 2, further including a third switchable path connected across the coil and wherein the control circuit is adapted to close the third switchable path so as to short said coil thereby producing "persistent current" through the coil.

5. The converter topology according to claim 4 for use with an AC power line.

6. The converter topology according to claim 4 for use with a DC power line.

7. The converter topology according to claim 4, wherein the power source is a single phase AC-grid.

8. The converter topology according to claim 4, wherein the power source is a three phase AC-grid.

9. The converter topology according to claim 8, wherein the load is a 3-phase load directly connected to a 3-phase AC-grid.

10. The converter topology according to claim 2, where the switchable paths include:

a first switchable path independently and selectively connecting opposite ends of the coil to the power source and GND, and a second switchable path independent of the first switchable path, independently and selectively switching opposite ends of the coil to respective terminals of the load.

11. The converter topology according to claim 10, wherein at least one of the switchable paths contains a rectifier diode which is biased to block current flow of a predetermined polarity.

12. The converter topology according to claim 10, further including a third switchable path connected across the coil and wherein the control circuit is adapted to close the third switchable path so as to short said coil thereby producing "persistent current" through the coil.

13. The converter topology according to claim 12, for use with an AC power line.

14. The converter topology according to claim 12, for use with an DC power line.

15. The converter topology according to claim 12, wherein the power source is a single phase AC-grid.

16. The converter topology according to claim 12, wherein the power source is a three phase AC-grid.

17. The converter topology according to claim 16, wherein the load is a 3-phase load connected to a 3-phase AC-grid.

* * * * *